United States Patent [19]

Williams

[11] Patent Number: 4,730,827

[45] Date of Patent: Mar. 15, 1988

[54] HAND REHABILITATION DEVICE

[76] Inventor: George R. Williams, 504 Countryside Trail, Edmond, Okla. 73034

[21] Appl. No.: 933,520

[22] Filed: Nov. 21, 1986

[51] Int. Cl.[4] ..... A63B 21/30

[52] U.S. Cl. ..... 272/68; 272/67; 272/93; 272/116; 272/141

[58] Field of Search ..... 128/26; 272/93, 141, 272/135, 68, 67, 116; D21/198, 222; 132/1, 73, 73.5, 75.8, 76.4, 76.5, 88.5

[56] References Cited

U.S. PATENT DOCUMENTS

| | | | |
|---|---|---|---|
| D. 192,927 | 5/1962 | Ernst | D21/198 |
| D. 275,302 | 8/1984 | Rotella | D21/198 |
| 1,623,869 | 4/1927 | Giraldi | 272/68 X |
| 2,271,164 | 1/1942 | Sullivan | 272/68 |
| 2,461,695 | 2/1949 | McMahon | 272/68 X |
| 3,265,389 | 8/1966 | Carlson | 272/68 |

FOREIGN PATENT DOCUMENTS

| | | | |
|---|---|---|---|
| 566149 | 9/1975 | Switzerland | 272/68 |
| 568609 | 4/1945 | United Kingdom | 272/67 |

*Primary Examiner*—Richard J. Apley
*Assistant Examiner*—Howard Flaxman
*Attorney, Agent, or Firm*—Robert K. Rhea

[57] ABSTRACT

A hand rehabilitation device including a circular planar disk having a series of spread-apart recesses in its circumference receives the fingers of a patient's hand with the thumb inserted through a selected one of a plurality of apertures. The joint of the finger extending across the disk may be active or passively exercised while the patient holds the disk.

2 Claims, 7 Drawing Figures

HAND REHABILITATION DEVICE

This invention relates to physical therapy and more particularly to rehabilitation of hands.

BACKGROUND OF THE INVENTION

1. Field of the invention

The device of this invention is intended for use by therapists, doctors, nurses, trained medical personnel and/or patients after training by a therapist.

Rehabilitation training of hands is necessary and in most cases restores hands to useful function. The device is particularly adapted for hands hampered by arthritis, reimplantation of fingers, stiff fingers, weak musculature conditions, shortened tendons and many other hand deficiencies or deformities well known in the medical profession.

2. Description of the Prior Art

Prior patents generally disclose relatively small hand held devices which increase the dexterity of fingers by manipulating the device, or are directed toward glove-like devices which receive the hand, fingers and thumb wherein the fingers and thumb are biased to close or biased straight in opposition to the condition of the hand. Another generally well known hand and finger exerciser, generally known as a "finger crutch", comprises a generally rectangular section of semi-resilient material, having end recesses defining a Y-shape at each end of the device, and when upright supports one or more digits for passive or resistive flexion of the fingers and exercising the joints thereof.

While the devices disclosed by prior patents, and the above described finger crutch are generally satisfactory, they offer only limited rehabilitation features for many conditions of hand impairment.

This invention is distinctive over the above described prior art devices by forming a disk-like member provided with recesses in its periphery, and at least one aperture for the thumb for individually or simultaneously exercising or manipulating all digits of a patient's hand, and strengthing the muscles and tendons thereof.

SUMMARY OF THE INVENTION

One embodiment comprises a planar disk of selected thickness and predetermined diameter, the dimensions being selected to accommodate a range of sizes of patient's hands from small to large. The peripheral edge of the disk is provided with a plurality of substantially semi-circular recesses for nesting intermediate portions of the patient's fingers when the disk is grasped by the hand. The central portion of the disk is provided with a plurality of thumb receiving apertures.

A second embodiment comprises a circular disk having a plurality of finger and thumb apertures which is secured on a spastic hand by a strap. Another embodiment similarly comprises a planar section of resilient material, generally rectangular, and provided with a row of graduated size spaced-apart apertures. Each of the apertures is diametrically intersected by longitudinally dividing the device and hingedly connecting the two halves, thus permitting hinged movement of the two sections toward and away from each other. The apertures surround intermediate portions of fingers in gripping relation when disposed therein.

The principal objects of this invention are to provide a hand rehabilitation device for promoting correction of physical impairment of the hand by manipulating the joints of fingers, strengthening hand and finger muscles by exercise in otherwise useful but hampered hands.

DESCRIPTION OF THE PREFEFFED EMBODIMENTS

Figure 1:
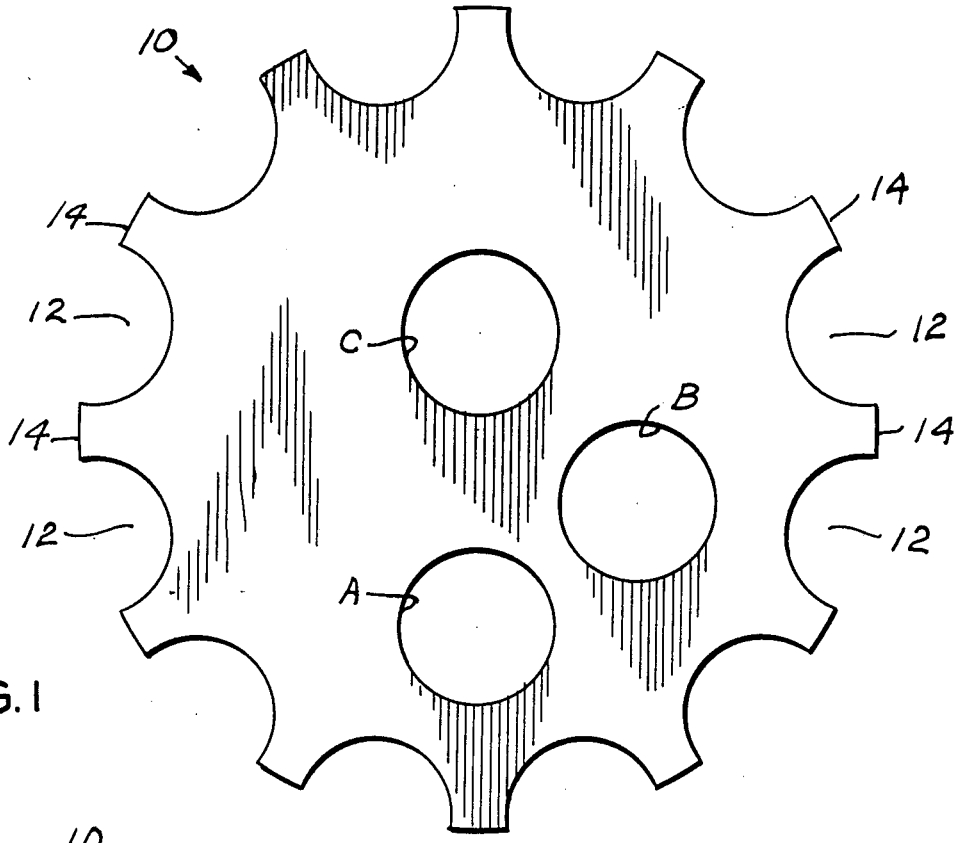
FIG. 1 is a top view of a preferred finger and hand manipulating disk.
Figure 2:
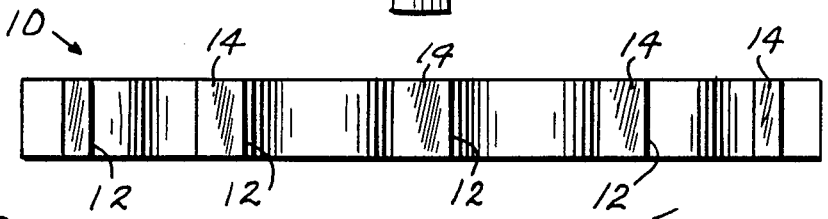
FIG. 2 is a side elevational review thereof.

Like characters of reference designate like parts in those Figures of the drawings in which they occur. In the drawings:

The reference numeral 10 indicates a generally circular planar section of semi-resilient rubber-like material having a memory returning it to its planar state when released after being manually bent, ssqueezed or deflected and of selected thickness, for example, ½ inch (1.27 cm) and a diameter of approximately 5⅜ inches (13.65 cm) in the example shown. The periphery of the disk 10 is provided with a plurality, twelve in the example shown, substantially semi-circular cutouts or recesses 12 in circumferentially spaced relation. The spacing between the respective adjacent recesses define radially projecting prongs 14, which are respectively interposed between adjacent fingers when the fingers are transversely extended across the respective recess. The disk 10 is further provided with a plurality of apertures A, B and C for respectively receiving the thumbs different size hands of patients.

The numeral 15 indicates a second embodiment of the disk intended principally for spastic hands which is provided with four finger openings 16 in relatively close spaced relation. A pair of thumb holes 17 are provided and spaced to accommodate hands of different size. The disk is further provided with an pair of slits 18 for receiving a belt or strap 19 which secures the disk to the wrist of the patient when the thumb and fingers have been placed within the respective holes or openings. The principal feature of this disk is that it provides some relief to the patient from drawing of tendons and cramping of the hand muscles.

Figure 4:
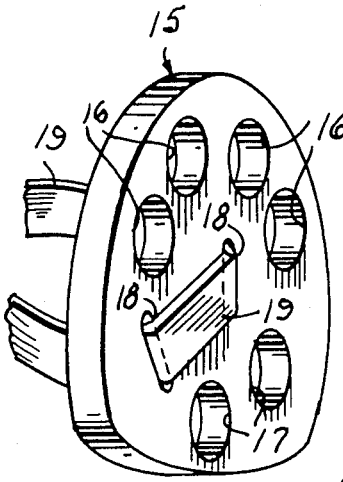
FIG. 4 is a perspective view of another embodiment.
Figure 3:
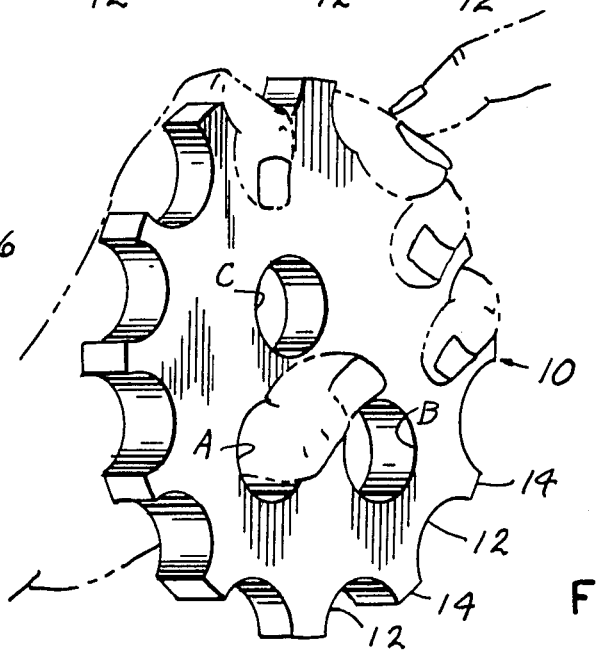
FIG. 3 is a perspective view of the disk illustrating one position of a hand and fingers positioned for passive and resistive exercise of finger joints.
Figure 6:
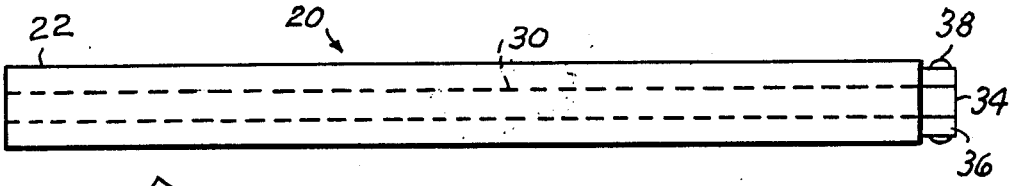
FIG. 6 is a top view of FIG. 5.
Figure 5:
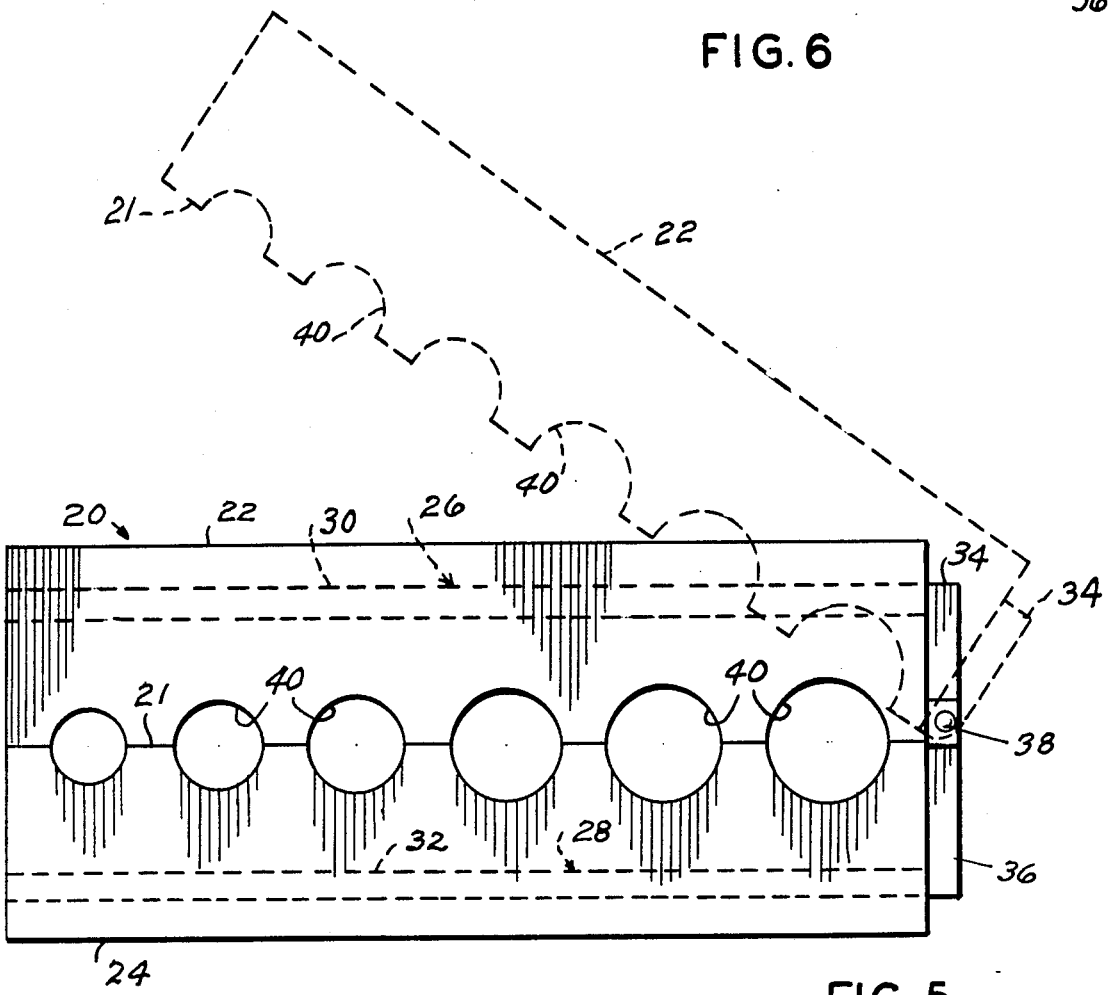
FIG. 5 is a side elevational of another embodiment.
Figure 7:
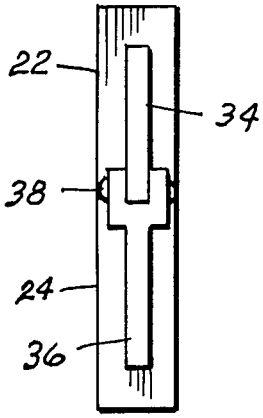
FIG. 7 is a right end elevational view of FIG. 6.

Referring now to FIGS. 3–5, the reference numeral 20 indicates a generally rectangular section of similarly resilient material substantially equal in thickness with the device 10. The device 20 is longitudinally divided medially its width as at 21, to form top and bottom sections 22 and 24, as viewed in the drawings. A pair of L-shaped metallic members 26 and 28 have their leg portions 30 and 32 longitudinally embedded within the respectively resilient section 22 and 24 intermediate the width thereof. The end of the bottom leg foot portion 36 is bifurcated for receiving the end of the top leg foot portion 34 to hingedly join the respective L-shape stiffeners by a hinge pin 38 for pivoting movement of the two sections toward and away from each other. Prior to longitudinally dividing the device 20 a plurality of graduated size apertures 40 are formed therethrough defining a longitudinal row of apertures diametrically intersected by the dividing line 21.

OPERATION

In the operation of the preferred embodiment 10 the thumb of the patient is inserted through a selected one of the apertures A, B or C in accordance with the size of the patient's hand relative to the disk. The fingers of the hand are disposed in selected recesses 12 opposite the thumb in a neutral position hand grip of the disk as illustrated by FIG. 3. In this position the distal interphalangeal joints may be actively exercised in their range of motion in a passive mode, or active resistive exercise as by pressure from the finger of the patient, or an attendant's finger on one or more of the fingers of the patient gripping the disk with the thumb remaining in the aperture, illustrated by FIG. 3.

The fingers may all be moved one notch to the right or left as viewed in the drawing for radial or ulnar deviation of the fingers. Further the hand my be placed flat upon the disk with the disk lying flat on a planar surface adjacent one edge thereof, which allows the metacarpal phlangeal joints to be flexed in a passive or active range of motion 90° with respect to the plane of the disk. Additionally one or more of the fingers may be inserted through the thumb aperture for metacarpal phlangeal extension in an active or passive range of motion for proximal or distal interphalangeal joint extension or flexion separately or simultaneously.

This brief description of operation is only intended as a summary of the numerous hand and finger exercises available by the us of this disk.

In the operation of the other embodiment 20 one or more of the patients's fingers are placed within a selected one of the apertures 40 with the device in open position. The two halves, 22 and 24 of the device are juxtaposed in resilent gripping pressure on the fingers so that they may be passive or actively resistive exercised by bending the finger at the problem joint.

Obviously the invention is susceptible to changes or alterations without defeating its practicability. Therefore, I do not wish to be confined to the preferred embodiment shown in the drawings and described herein.

I claim:

1. A hand rehabilitation device, comprising:

a planar circular disk formed from material returning to a position of repose after being manually flexed, said disk having an uninterrupted circumferential series of closely spaced substantially semicular recesses extending about the entire periphery of said disk, thereby separately nesting an intermediate portion of a patient's respective fingers when transversely disposed therein and having at least one thumb receiving aperture in its central portion diametrically spaced from a designated arc of the disk periphery a distance requiring a patient to fully open his hand when simultaneously inserting his thumb in the thumb aperture and disposing intermediate portions of his fingers in the designated arc recesses.

2. The device according to claim 1 in which the ratio of thickness to diameter of said disk is at least 1:10.

* * * * *